US007033077B2

(12) United States Patent
Taylor

(10) Patent No.: US 7,033,077 B2
(45) Date of Patent: Apr. 25, 2006

(54) SEALABLE BAGS MADE OF PLASTICS OR OTHER MATERIALS AND METHOD OF MAKING PLASTIC SHEETING FOR MANUFACTURING SEALABLE BAGS

(76) Inventor: Peter Taylor, 17026 Innis Lake Road, Caledon East, ON L0N 1E0 (CA)

( * ) Notice: Subject to any disclaimer, the term of this patent is extended or adjusted under 35 U.S.C. 154(b) by 289 days.

(21) Appl. No.: 10/453,284

(22) Filed: Jun. 3, 2003

(65) Prior Publication Data

US 2004/0013322 A1 Jan. 22, 2004

Related U.S. Application Data

(60) Provisional application No. 60/428,290, filed on Jul. 16, 2002.

(51) Int. Cl.
*B65D 33/16* (2006.01)

(52) U.S. Cl. ..... 383/62; 383/86; 383/95

(58) Field of Classification Search ..... 383/62, 383/93, 95, 84, 86; 229/80
See application file for complete search history.

(56) References Cited

U.S. PATENT DOCUMENTS

| | | | | |
|---|---|---|---|---|
| 2,081,052 | A * | 5/1937 | Heywood | 229/80 |
| 2,367,440 | A | 1/1945 | Schieman | |
| 2,861,735 | A * | 11/1958 | Faltin | 383/11 |
| 3,420,433 | A * | 1/1969 | Bostwick | 229/80 |
| 3,942,713 | A * | 3/1976 | Olson et al. | 383/62 |
| 3,990,627 | A | 11/1976 | Olson | |
| 4,410,130 | A | 10/1983 | Herrington | |
| 4,513,445 | A | 4/1985 | Kamp | |
| 4,581,007 | A | 4/1986 | Kamp | |
| 4,785,940 | A | 11/1988 | Wilson | |
| 4,932,791 | A | 6/1990 | Vetter | |
| 5,788,377 | A | 8/1998 | Vetter | |
| 5,908,243 | A | 6/1999 | Hanning | |
| 5,931,581 | A | 8/1999 | Garberg et al. | |
| 6,290,120 | B1 | 9/2001 | Guest | |
| 6,467,957 | B1 | 10/2002 | Yeager | |

* cited by examiner

*Primary Examiner*—Jes F. Pascua
(74) *Attorney, Agent, or Firm*—Scott D. Wofsy; Edwards Angell Palmer & Dodge LLP

(57) ABSTRACT

A bag comprising first and second walls which are connected together along their sides and bottom and a flap portion which is connected to a top of one of the walls. The flap portion and this one wall together form a transversely extending Z-fold. An adhesive strip is provided for closing an open mouth of the bag and this strip extends in a transverse direction across an inner surface of said one wall. A protective band extends in a transverse direction across an inner section of the flap portion so as to cover and contact the adhesive strip. The flap portion also has a projecting outer section which can be pulled outwardly away from the interior of the bag to expose the adhesive strip. A method of making modified plastic sheeting suitable for making these sealable bags is also disclosed. Using one method, an aqueous coating of release material is applied as a band to a strip of plastic sheeting by means of a printing press. This band is then dried using a hot air dryer.

23 Claims, 11 Drawing Sheets

SEALABLE BAGS MADE OF PLASTICS OR OTHER MATERIALS AND METHOD OF MAKING PLASTIC SHEETING FOR MANUFACTURING SEALABLE BAGS

RELATED APPLICATION

This application claims priority on the basis of U.S. provisional patent application No. 60/428,290 filed Jul. 16, 2002 and entitled "PLASTIC BAG".

FIELD OF THE INVENTION

This invention relates to bags and, in particular, to bags having a mechanism or device for closing or sealing same, and further relates to methods of making modified plastic sheeting which can be used in the manufacture of sealable plastic bags.

BACKGROUND OF THE INVENTION

Plastic bags have become a necessary fixture of retail trade. A significant portion of merchandise is packaged in plastic bags before being delivered to retail operations or before being delivered to customers. A variety of products which are directly delivered to consumer homes, such as newspapers and magazines, are also packaged in plastic bags in order to protect the contents from rain and snow. Also, when consumers purchase items at retail stores, the check-out staff often place the purchased items in plastic bags which often have printed thereon designs such as the retail store's trademarks. These trademarks and designs can help to identify the source of the purchased items and color images and designs can improve the appearance of the bag. The plastic bag that can be used for many of these packaging tasks generally consist of a tubular plastic bag or envelope having a closed end and an opposite opened end. The article is placed in the bag or envelope through the open end and then the bag or envelope can be closed by a variety of means. The term "bag" as used herein is used in its broadest sense (unless the context indicates the contrary) and is meant to include such common bag-like items such as envelopes and pouches.

Variety of devices have been developed for closing the open end of a bag or envelope. For example, twist ties, draw strings and draw tape have been widely employed to close the open end of a bag. Other known closing methods used for bags and/or envelopes include lock-tops, Velcro strips, flip top flaps, moisture activated adhesive strips, pressure sensitive adhesive strips and heat seal closures. Also, it is well known to construct plastic bags with built-in "zipper like" self-closing features which are provided adjacent the open end of the bag and can aid in sealing the bag shut. For example, ZIPLOC® plastic bags have a formed zipper like track formed on the inside of the film surface. It is also known to provide plastic bags which incorporate an adhesive strip that can be used to seal the open end of the bag.

U.S. Pat. No. 3,990,627 which issued Nov. 9, 1976 to Mobile Oil Corporation describes an adhesive closure for a bag such as a sandwich bag. An adhesive strip is located adjacent the open mouth portion of the bag and is covered until ready for use by the upper portion of the bag's front wall. Upward displacement of this upper portion of the front wall exposes the adhesive strip so that it can be used for sealing purposes. The flap section which covers the adhesive strip prior to its use is provided with a strip of release material that is placed in contact with and covers the adhesive strip.

More recent U.S. Pat. No. 4,410,130, which also issued to Mobile Oil Corporation, describes other forms of Z-fold closures for thermo-plastic bags. These closures also employ pressure sensitive adhesive strips as well as a protective strip having one or more ribs so that the strip of adhesive is substantially contacted by only the top portions of the ribs when the bag closure is in the Z-fold position. The protective strips can be made from polyethylene.

While such previously used plastic bags with closure devices have been used with some success for a number of years, there is still a need for an improved sealable bag which can be used quickly and easily and which can be manufactured at a relatively low cost.

Accordingly, it is an object of the present invention to provide an improved bag which includes an adhesive strip for closing an open mouth portion of the bag and a protective band which can extend over and protect the adhesive strip until the bag is ready to be used, this bag also being producible at a reasonably low cost.

It is a further object of the present invention to provide a bag, and in particular a plastic bag, which includes a closure device in the form of an adhesive strip covered by a protective coating, the latter being made by an aqueous coating of release material applied directly to the plastic sheeting using a printing press or coating machine, this coating having been dried and formed prior to forming the bag from the plastic sheeting.

It is a further object of the present invention to provide an improved and inexpensive method of making modified plastic sheeting suitable for manufacturing sealable bags, each provided with a band of release material.

SUMMARY OF THE INVENTION

According to one aspect of the invention, a bag comprises a first wall and a second wall, the walls being joined by their side edges and forming an open mouth portion proximate to top edges of the walls. A flap portion connected to the second wall has opposite side edges and a free top edge, the latter being spaced above the top edge of the first wall. The flap thus has a projecting outer section extending above the open mouth portion and the flap portion and the second wall together form a transversely extending Z-fold. The flap portion also has an inner section connected along a first fold line of the Z-fold to the second wall and extending into the interior of the bag in an initial position thereof. The bag also includes an adhesive strip arrangement for closing the open mouth portion, this strip arrangement extending in a transverse direction across one of an inner surface of the second wall and an inner surface of the inner section of the flap portion. The adhesive strip arrangement is located proximate the top edge of the second wall. A protective band extends in a transverse direction across the other of the inner surface of the second wall and the inner surface of the inner section of the flap portion so as to cover and contact the adhesive strip arrangement. The projecting outer section of the flap portion can be pulled outwardly way from the interior of the bag to expose the adhesive strip arrangement in order to close the open mouth portion during use of the bag.

Preferably, the length of the projecting outer portion of the flap is at least one-half inch. Also, the protective band preferably has a width as measured in the longitudinal direction of the bag which exceeds the maximum width of the adhesive strip arrangement measured in the same direction.

According to a further aspect of the invention, a bag comprises first and second bag walls joined along their side edges and forming an open mouth portion proximate to top edges of the walls, the walls having a width measured between the side edges. A flap portion is connected to the top edge of the second wall and has opposite side edges and a free top edge. The flap portion and the second wall together form a transversely extending Z-fold having first and second fold lines. The first fold line is located at the junction of the second wall and the flap portion. The flap portion includes a transversely extending first section having opposite ends formed by the first and second fold lines and extending into the interior of the bag in an initial position thereof. The flap portion also includes a transversely extending second section located between the second fold line and the top edge of the flap portion. At least a substantial portion of the first section has a reduced width which is less than the width of the walls. An adhesive strip arrangement for closing the open mouth portion extends in a transverse direction across one of an inner surface of the second wall and an inner surface of the first section of the flap portion, the adhesive strip means being proximate the top edge of the second wall. A protective band extends in a transverse direction across the other of the inner surface of the second wall and the inner surface of the first section of the flap portion so as to cover the adhesive strip arrangement. The flap portion can be pulled outwardly way from the interior of the bag to expose the adhesive strip arrangement in order to close the open mouth portion during use of the bag. The reduced width of the first section of the flap portion prevents this reduced width portion from being joined to the bag walls during the making of the bag.

In one preferred embodiment of the plastic bag, the band of protective coating has a width as measured in the longitudinal direction which exceeds the maximum width of the adhesive strip arrangement measured in the same direction. The flap portion can be formed with two side notches located on opposite side edges thereof.

According to yet another aspect of the invention, a sealable bag comprises first and second walls joined along their side edges and forming an open mouth portion proximate to the top edges of the walls. A flap portion connected to the second wall has opposite side edges and a free top edge, the flap portion and the second wall together forming a transversely extending Z-fold. The flap portion includes an inner section connected along a first fold line of the Z-fold to the second wall and extending into the interior of the bag in an initial position. A continuous adhesive strip for closing the open mouth portion extends in a transverse direction across an inner surface of the second wall and is located proximate the top edge of the second wall, the adhesive strip having a total length measured in the transverse direction of the bag which is less than the transverse width of the bag. Opposite ends of the adhesive strip are located immediately next to or in sealed edge areas of the bag where the first and second walls are sealingly connected. A protective band extends in a transverse direction across the inner section so as to cover and contact the adhesive strip. During use of the bag, the flap portion can be pulled away from the interior of the bag to expose the adhesive strip which can then be used to close the open mouth portion in a substantially watertight manner.

Further features and advantages of the bags will become apparent from the following detailed description, taken in conjunction with the accompanying drawings.

DETAILED DESCRIPTION OF PREFERRED EMBODIMENTS

In the accompanying drawings it will be understood that like characters of reference indicate corresponding parts in the different figures. Also, as used herein, the term "bag width" is the width as typically illustrated in FIG. 1 between side edges 15 and 17. Also, the term "flap width" used herein is the full or maximum width of the flap portion as typically illustrated in FIG. 1 measured in the same direction as the aforementioned bag width.

Figure 1:
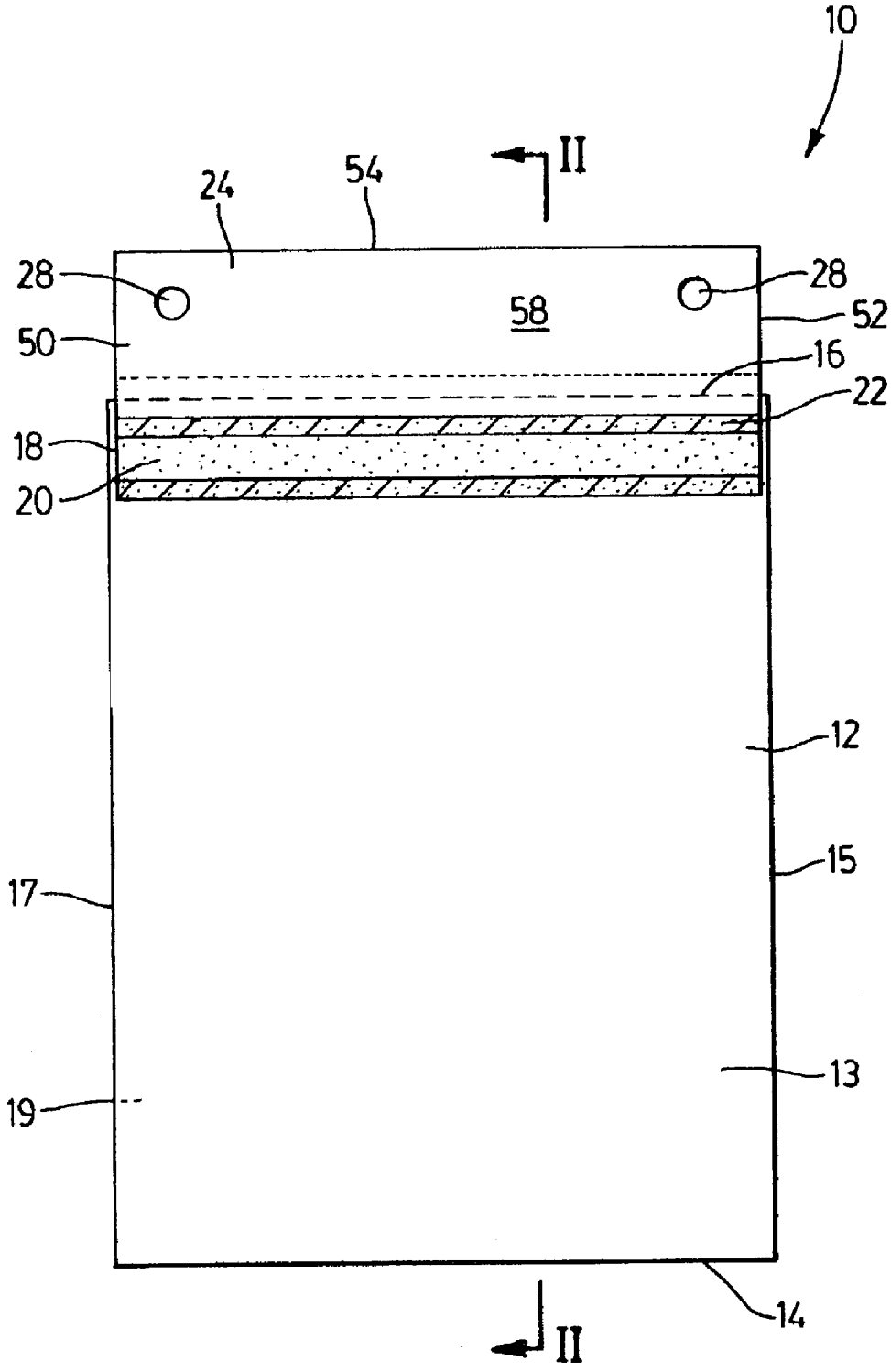
FIG. 1 is a rear view of a bag made in accordance with the present invention.

With reference to FIG. 1, a bag made in accordance with the present invention is indicated generally as item 10 and it consists of an envelope 12 having a closed end 14 and the aforementioned opposite sides 15 and 17. The bag or envelope 10 can be made of different materials normally used in the construction of bags but in a particularly preferred embodiment it is made of plastic sheeting. The illustrated bag also has an open end 16 and an integral adhesive closure or adhesive strip means 18 positioned adjacent open end 16. The adhesive closure 18 includes an adhesive strip 20 and extends in a transverse or widthwise direction across an inner surface of the bag. The bag 10 includes a first wall or front sheet 19 and a second wall or back sheet 13. These sheets or walls are joined in a sealing manner along their side edges and at the bottom or closed end 14. Forming the open end 16 is an open mouth portion of the bag which is formed by the walls approximate to their top edges. The sealed side edges 17 and 15 can be formed by known methods of sever-sealing. As used herein, sever-sealing is intended to encompass all methods of simultaneously producing two side sealed edges with a separation between the edges. Thus the term "sever-sealing" includes conventional hot knife sealers as well as hot wire sealers and mixed sealers consisting of two bar seals with a cut off between the bar seals.

The bag 10 also includes a flap portion or tab portion 24, which is integrally connected to a top end of the second wall 13 and which has free opposite side edges 50, 52 and a free top edge 54. The top edge 54 is preferably spaced above the top edge 56 of the first wall 19. The flap portion 24 thus has a projecting outer section 58 which extends above the open mouth portion 16. As can also be seen from FIGS. 2 and 7, the flap portion 24 and the second wall 13 together form a transversely extending Z-fold in a first or initial position of the bag. Thus, the combination of the front sheet 13 and the flap portion are folded along a first fold line 60 which is part of this Z-fold. There is also a second fold line 62 which is parallel to the first fold line and is formed in the flap or tab portion 24.

Figure 2:
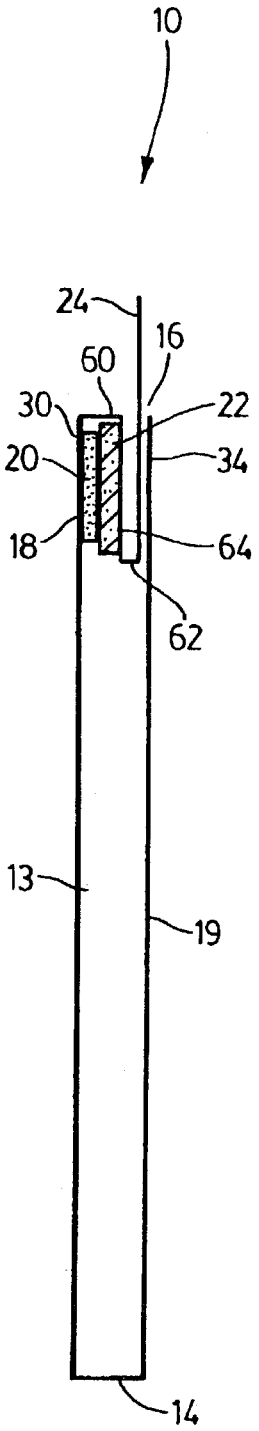
FIG. 2 is a longitudinal sectional view of the bag taken along the line II—II of FIG. 1.
Figure 3:
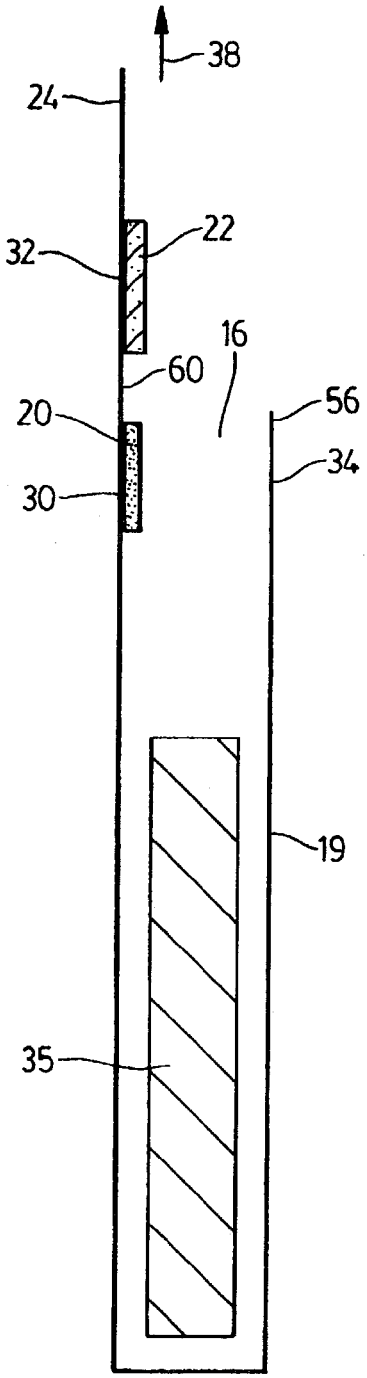
FIG. 3 is a longitudinal sectional view similar to FIG. 2 but showing the flap portion of the bag pulled upwardly and an object inserted into the bag.
Figure 4:
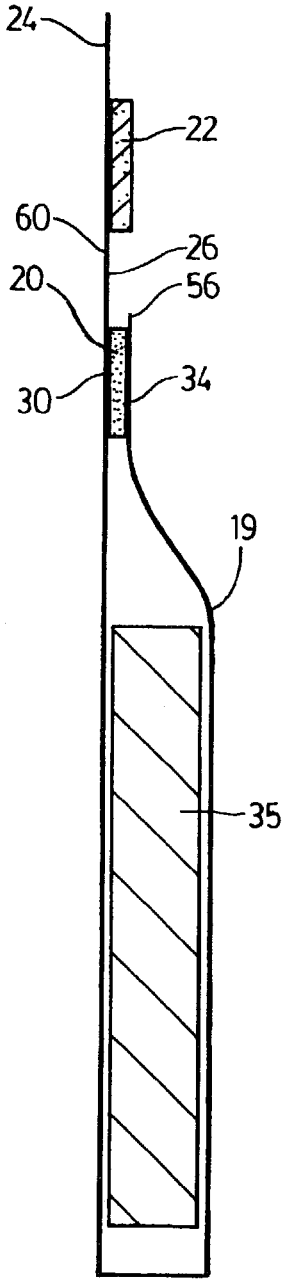
FIG. 4 is a longitudinal sectional view similar to FIG. 3 but showing the bag in the closed position with the adhesive strip contacting an opposite wall of the bag.
Figure 7:
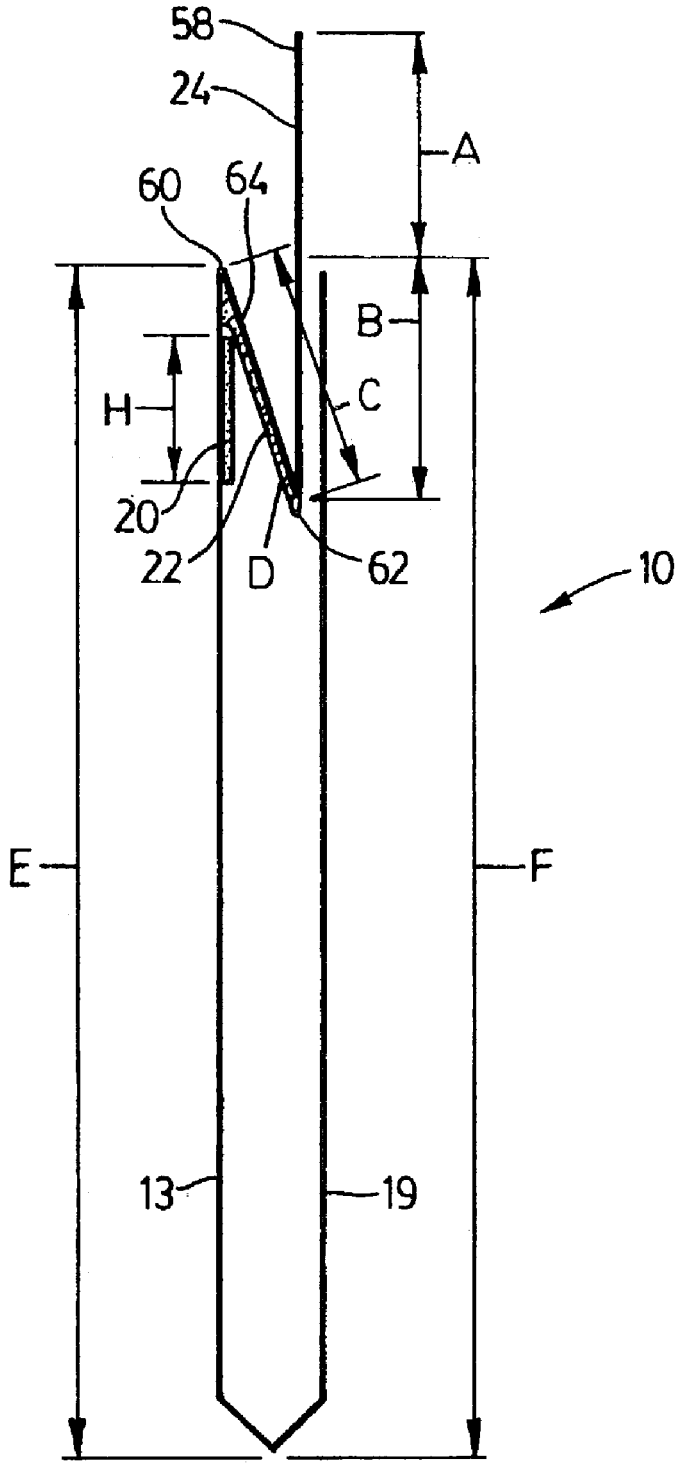
FIG. 7 is a longitudinal cross-sectional view similar to FIG. 2, this view illustrating various dimensions of the preferred bag and its component parts.

Another significant aspect of the bag or envelope 10 is the provision of protective band means indicated generally at 22 which forms a release strip. In this preferred embodiment, the protective band means or strip is formed on the flap portion or tab portion 24 adjacent the open end 16. Because of the aforementioned Z-fold, the protective band or release strip is folded over to cover the adhesive strip 20 as shown. The protective band 22 extends in a transverse direction across one surface of an inner section 64 of the flap portion in this first embodiment. This inner section is connected along the first fold line 60 to the second wall 13 and extends into the interior of the bag 10 in the initial position thereof and as shown in FIGS. 2 and 7. It will also be noted that the adhesive strip 20 is located proximate to the top edge of the second wall 13, this top edge corresponding to the first fold line 60. The adhesive strip is also adjacent the inner section 64 of the flap portion. It will be appreciated that the projecting outer section 58 of the flap portion can be pulled outwardly away from the interior of the bag or envelope to expose the adhesive strip as illustrated in FIG. 3. This will be done when the bag is to be used to enclose an item, or article 35 which might, for example, be a wide variety of food or non-food items and printed materials. Once the adhesive strip is exposed, it can be used to close the open mouth portion of the bag as illustrated in FIG. 4. The adhesive strip 20 can be adhered to a top section of the first wall 19.

With reference now to FIG. 2, the second wall or back sheet 13 and the flap portion adjacent the open mouth include respectively parallel portions 30 and 64. These parallel portions 30 and 64 are separated by the first fold line or central strip 60. The adhesive strip is applied to the inside surface of the parallel portion 30 so that it is between the wall portion 30 and the inner section 64 when the latter is folded inwardly. As illustrated in FIGS. 2 and 7, the adhesive strip is preferably completely covered by the protective band or release strip 22.

The preferred adhesive strip 20 is made by applying a layer of suitable adhesive onto the inside surface of the portion 30 of the second wall 13 and letting the adhesive cure, at least partially. In a preferred method of making the bag 10, the adhesive is applied by means of a known form of adhesive application gun, for example, that made by Nordson, and this can be done by mounting the gun on an armature during the bag manufacturing operation. Prior to application of the adhesive, the inside surface of the second wall 13 can be treated, for example, by a Corona treatment, so that a maximum bond will be created between the adhesive material and the plastic film surface. Although the adhesive can take various forms, depending upon for example the type of material from which the bag is made and the intended application of the bag, in a preferred embodiment the adhesive strip is a pressure sensitive adhesive (PSA) suitable for sealing the two walls 13 and 19 together. Again, depending upon the web material used to manufacture the bag, a variety of adhesives are commercially available, including UV curable adhesives, hot melt adhesives (PSA), water based adhesives and solvent based adhesives. For ease of production, a UV curable adhesive can be used. As will be well understood to those skilled in the bag making art, the first and second walls 13 and 19 can be made from one sheet of web material or, alternatively, they can be formed from two separate sheets of web material that are heat sealed together, such as by heat sealing or any other suitable sealing method, at the closed end 14.

The protective band or release strip 22 can be applied as a coating of release material and it is provided on the inside surface of the inner section 64 in the first embodiment of FIGS. 1 to 4. As explained further hereinafter, it can be provided as an aqueous coating that can subsequently be dried and thus cured. The release strip is adapted to adhere loosely to the adhesive strip without bonding to it. A variety of silicone based release materials are commercially available and can be used for making the release coating. A preferred form of this release material is a water or solvent based release varnish capable of being applied by a printing press. Instead of providing the protective band or release strip 22 on the plastic sheeting prior to the manufacture of the bag 10, it is also possible to provide the release strip on the inner section 34 as the bag is being manufactured.

In the case of a plastic bag 10, the bag can be made of any suitable plastic film material such as polyethylene, a polypropylene, or another suitable thermoplastic. With the sealable bag construction of the invention, the plastic film or sheeting used in its construction can be less than 1.50 mil and even as thin as about 1.0 mil (0.001 inch). Prior art sealable bags employing an adhesive have required plastic films of 1.75 mil or more to be used. The plastic sheet material can be made up of single or multi-layer plastic material offering a wide variety of features such as printed surfaces, colored films or a metalized surface. Instead of plastic, the bag or envelope can be formed from standard material such as paper, coated paper or even thin gauge chip board. Also, in the case of plastic sheeting for the bag, this sheeting can be made of laminated films or even multi-layered co-extruded films, depending on the desired properties of the finished envelope or bag. Whatever material is used, the adhesive material for the adhesive strip 20 is selected on the basis that it will adhere to the chosen material.

To explain further how the bag 10 can be used, the bag 10 as manufactured is illustrated in FIG. 2 and this is the form in which the bag would be shipped for use. Thus, prior to use, the adhesive strip 20 is covered and protected by the band of release material 22. In this so-called "semi-closed position" the flap portion has been folded so that the protective band 22 is folded on top of the adhesive strip 20. The walls 13 and 19 are very close to each other and indeed, in most cases, they will be in overlapping contact prior to use of the bag. The protective band 22 prevents the lip portion or upper portion 34 of the first wall 19 from making contact with the adhesive strip. A user, desiring to insert the item 35 into the bag can open end 16 by pulling the lip portion 34 away from the folded flap portion as shown in FIG. 3.

To seal the open end 16 after the item or object 35 has been inserted into the bag, the user then pulls on the outer section 58 of the tab or flap portion in the direction of the arrow 38 (that is, upwardly if the bag is being held vertically as shown in FIGS. 2 to 4) while holding onto the bag. Pulling on the tap or flap portion causes the inner section 64 to be flattened out or pulled out of the interior of the bag and this in turn pulls the protective band 22 off of the adhesive strip 20 as shown in FIG. 3. With the adhesive strip exposed, the lip portion 34 can be pressed against the adhesive strip in order to close the bag. Thus, with the lip portion 34 pressed against the exposed adhesive strip, the adhesive strip securely seals the lip portion 34 to the upper portion 30 of the second wall 13. In other words, the end 16 of the bag is effectively closed and sealed. Moreover, as explained more fully below, the adhesive strip 20 can be made sufficiently long that the adhesive extends right to sealed together edge areas of the bag walls, thus ensuring the ability to create an excellent, waterproof seal when the bag is closed correctly. The projecting outer section 58 should be sufficiently long to permit the user to grasp this outer section firmly. For many practical applications, the outer section 58 should be at least one half inch long to permit this outer section or tab to be grasped firmly. However, it can be made longer if the package is to have a wicket lip or if information or designs are to be printed on the outer section. Generally speaking, wicketed bags are faster and easier to handle, depending on how the package is being used with automatic bag handling equipment. The wicketed lip can be used to group the bags into collective units of 25 to 300 bags, depending on film gauge.

The nature of the seal formed between the upper-portion 30 and the lip portion 34 depends on the nature of the adhesive used to form the adhesive strip 20. If a strong, permanent seal is required, a high tack adhesive can be used. This type of seal can be particularly useful in security applications where the item 35 in the bag is intended to remain secure within the bag or envelope until the latter is opened by rupturing. Also, the adhesive strip can be formed as a tamper evidence security seal that will alert a user that another party had attempted to make entry into the bag to obtain the enclosed item 35. However, where the item 35 is to be periodically removed and then resealed back into the bag 10 or where the bag 10 is to be used a number of times, a resealable closure can be made by using a lower tack adhesive to form the adhesive strip 20. Also, it is possible to use two different adhesive strips as explained below in conjunction with FIG. 14.

Figure 5:
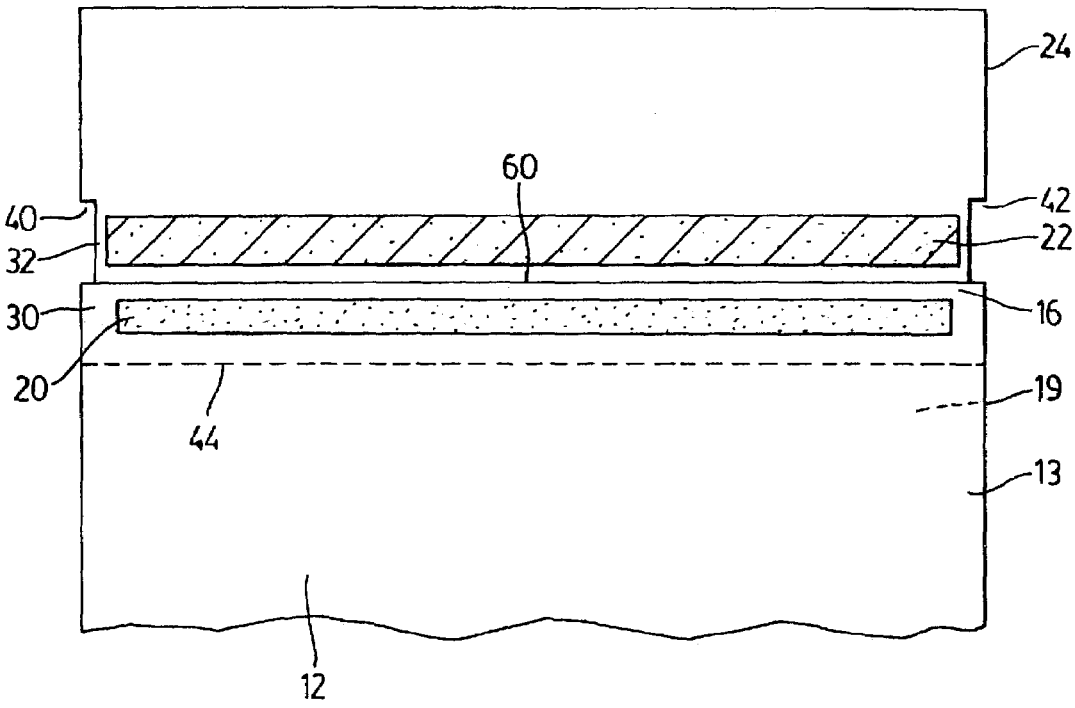
FIG. 5 is a partial front view of the bag of FIG. 1 showing the flap portion in its extended position with the adhesive strip exposed.
Figure 6:
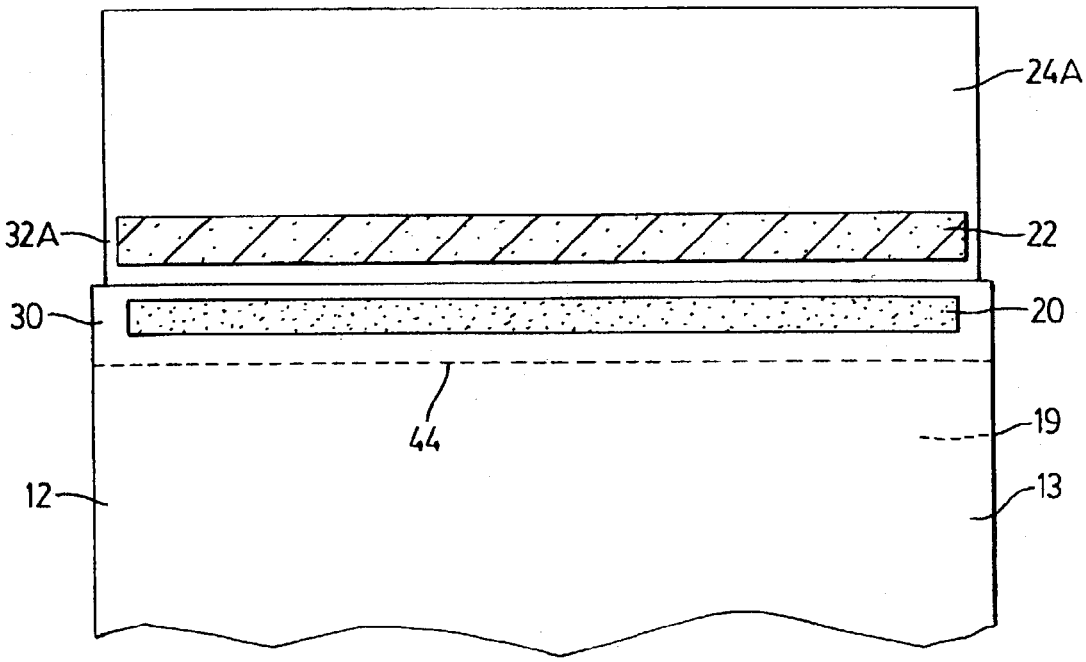
FIG. 6 is a partial front view similar to FIG. 5 but illustrating an alternate embodiment of the invention.

Referring now to FIG. 5, the flap portion 24 in this particular embodiment has an inner section 32 which is slightly narrower than the upper portion 30 of the second wall 13. Thus, the flap portion is formed with two side notches 40, 42 on opposite side edges thereof. As illustrated, these notches are proximate the first fold line 60 of the Z-fold. The provision of these notches permits the portion 32 of the flap to be folded into the opening 16 of the bag and onto the adhesive strip 20 without difficulty or without bunching. These notches also can be sized to ensure that during the bag formation and, in particular during the heat sealing of the sides 15 and 17 of the bag, the side edges of the inner section 32 will remain free and will not be attached to the adjacent walls of the bag. Alternatively, as shown in FIG. 6, the flap or tab portion 24A can be narrower than the width of the bag or envelope 12. As illustrated, the flap portion 24A is only slightly narrower than the bag 12 such that the portion 32A adjacent the opening of the envelope can be neatly folded into the envelope opening so that the release strip covers the adhesive strip 20.

Also shown in FIG. 6 is an optional perforated line or line of perforations 44 which can be formed on one or both of the walls 13 and 19 adjacent to and below the adhesive strip 20. This line of perforations or, alternatively, a line of weakness allows the bag to be easily opened by tearing along the line. Thus, the package recipient can gain easy access to the contents of the sealed bag 12 by simply tearing the bag along the line of perforations. This line of perforations will only be used for non-tamper evident applications.

As illustrated in FIGS. 2 and 7, the protective band 22 has a width as measured in the longitudinal direction of the bag which exceeds the maximum width of the adhesive strip 20 measured in the same direction. This helps to ensure within manufacturing tolerances that the adhesive strip does not project along one edge beyond the protective band, which could make it difficult to pull the flap portion upwardly to the position shown in FIG. 3. As shown in FIG. 1, the outer section 58 of the flap, which can form a wicket lip, is formed with two holes 28 suitable for placement on U-shaped wicket wires used widely in the bag manufacturing industry. Of course, the outer section could be formed with one hole 28 only or more than two holes, if desired. When the outer section 58 is to form a wicket lip, it preferably has a length of at least one and one-half inch.

Figure 8:
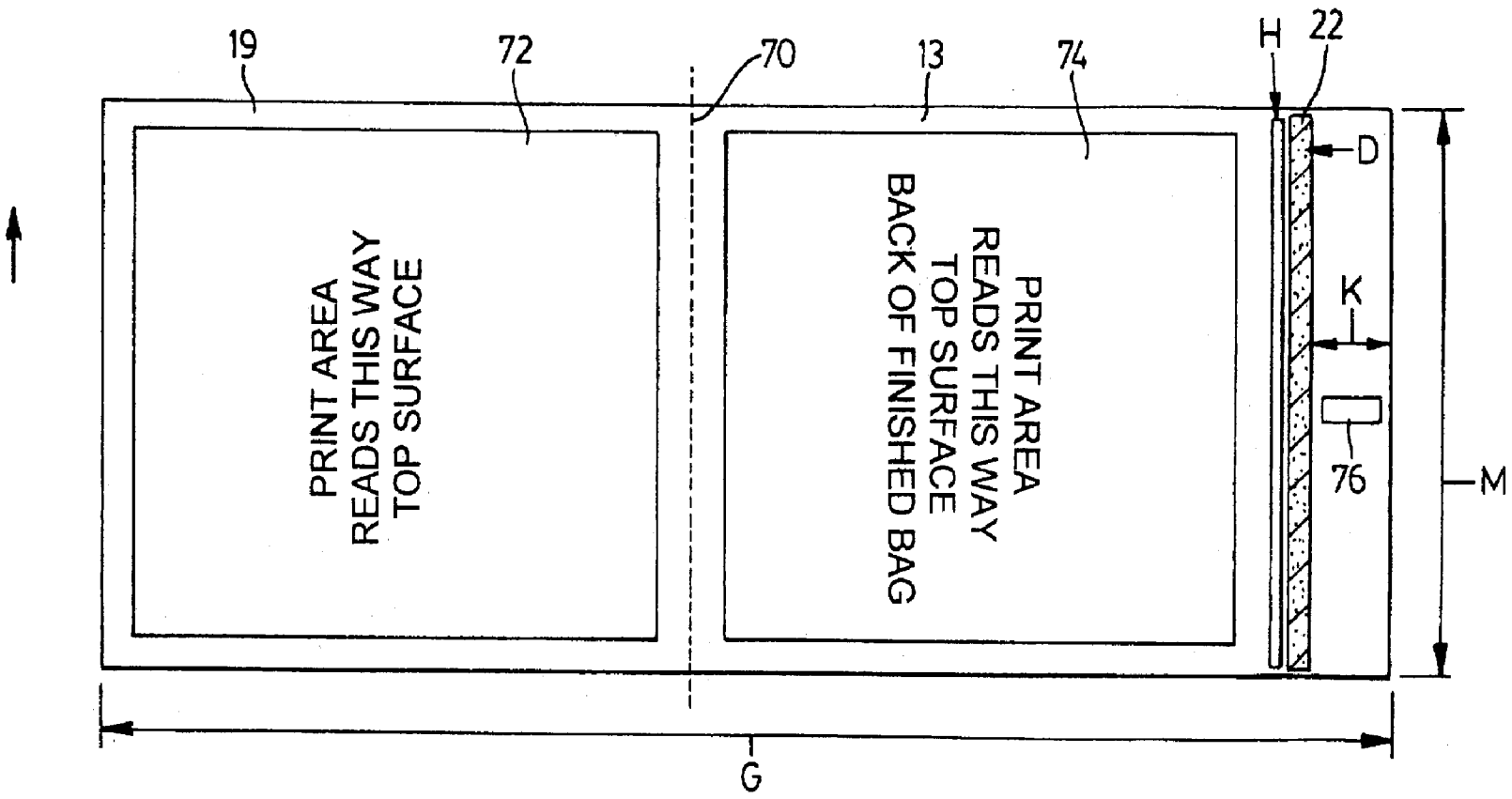
FIG. 8 is a plan view of a section of plastic sheeting for a bag constructed in accordance with the invention, this view showing the two walls for the bag laid out flat with a fold line centered between them and also showing print areas on both walls.
Figure 9:
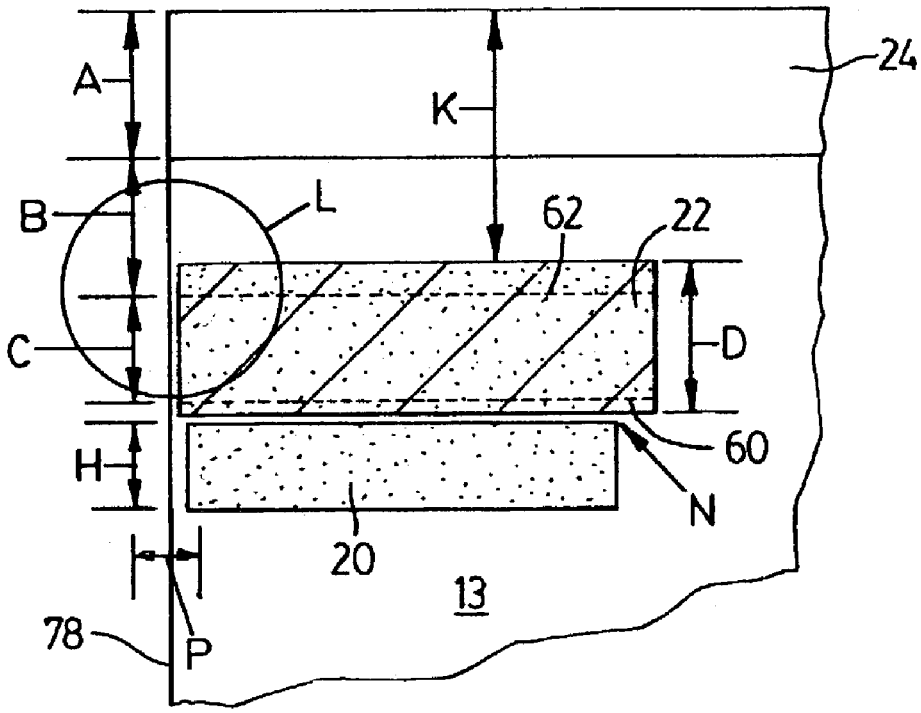
FIG. 9 is a detail view showing a top edge portion of a modified plastic sheet used to construct the preferred bag of the invention.
Figure 10:
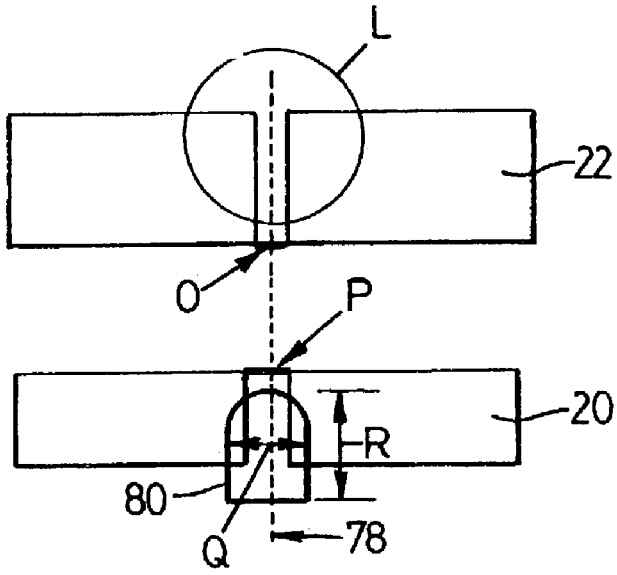
FIG. 10 is a detail view illustrating certain dimensions in the region between two plastic sheet sections with a bag seal line between them.

FIG. 7 illustrates one preferred construction of a bag 10 constructed in accordance with the invention. In particular, certain dimensions of this preferred bag have been indicted by the letters A to F and H in this figure. Other dimensions for this particular preferred bag are indicated in FIGS. 8 to 10. The distance A represents the height of the outer section 58 (also referred to as the wicket lip) and in the illustrated embodiment this dimension is 1.5 inches or 38.1 mm. The distance B is the distance that the flap portion 24 extends into the open end 16 and in the illustrated bag this distance is ⅝ inch or 15.88 mm. This is also the height C of the inner section 64. The distance C is equal to the distance B when the bag is completely flat and the protective band is in contact with the adhesive strip. The width D is the width of the preferred protective band 22 and in one preferred embodiment this width is 0.855 inch or 21.72 mm. It will be particularly noted that the preferred protective band 22 extends around both fold lines 60 and 62. This can also be seen clearly from FIG. 9, which shows the protective band 22 laid out flat. The distance E represents the height of the second wall 13 and in one particular bag the height is 18 inches or 45.72 cm. The distance F is the height of the first wall or front wall 19 and this height is also 18 inches. The distance H is the width of the adhesive strip 22 (that is, measured in the vertical direction) and in this bag the width is 0.393 inch or 9.98 mm.

Turning now to FIG. 8, this view shows the plastic sheeting for making a single bag laid out flat. It will be understood that the bag is formed by a suitable bag making machine by. folding the plastic sheeting along the fold line 70. Also shown in FIG. 8 are two rectangular areas 72 and 74 that are respectively located on the first wall 19 of the bag and the second wall 13. These areas indicate regions on the plastic sheeting where printing and designs can be applied by a printing press in a manner known per se prior to the actual formation of the bag. As explained further below, when this printing operation takes place, the protective band 22 can also be provided in the form of a coating. Typically, the printing in the form of text matter or designs can be applied by a printing press to the top or outer surface of the plastic sheeting while the protective band or release coating 22 is applied to the back of the plastic sheeting or web.

The dimensions of the preferred embodiment illustrated in FIG. 8 include the full film width G, which in one preferred embodiment (corresponding to that of FIG. 7), is 38.75 inches or 98.43 cm., but it will be appreciated that the laid out, full width of the plastic sheeting can vary substantially depending upon the particular bags or envelopes to be made. Another dimension illustrated in FIG. 8 is the distance of the release material from the edge of the plastic sheeting. This distance K is 1.89 inches or 48.11 mm in one preferred embodiment. The illustrated dimension M represents the bag repeat distance or approximately the transverse width of the bag which is 10 inches or 25.4 cm, in this particular embodiment. There can also be printed on the plastic sheeting at the same time as the text and designs, an optical eye mark 76. This eye mark can be used, for example, by the bag making machinery to determine when certain manufacturing operations take place, for example, detection of this eye mark by a triggering device can cause an automated punch device to operate to form a hole or cut out or notch in the web of plastic sheeting. If an eye mark is desired, the location can vary from that shown in FIG. 8.

Turning now to FIG. 9 of the drawings, this view is a detail view of the portion of the plastic sheeting that form an upper portion of the second wall 13 and the flap portion 24. The aforementioned dimensions A to D and H are shown in this figure as well as the dimension K. Also shown in this figure in dotted lines are the preferred locations of first fold line 60 and second fold line 62. These fold lines extending transversely in the region of the protective band 22. The distance N represents any gap between the adhesive strip 20 and the protective band 22 and in one particular preferred embodiment, this distance is in fact zero. There can, of course, be a small gap between the adhesive strip and the protective band 22, if desired. The vertical line 78 represents a cut line wherein the sheet sections forming two adjacent bags 10 are separated by the bag making machine. As indicated above, this severing process would normally be done at the same time the side edges 15 and 17 of each bag are formed by a heat sealing step. The distance P is the gap between adjacent ends of the adhesive strips 20 of adjacent web sections forming the bags. In one preferred embodiment, this gap in the adhesive is ⅜ inch or 9.53 mm. This gap can be significant in order to ensure that the adhesive strip for each bag is fully covered by the protective band 22, even at the ends of the adhesive strip.

Another feature illustrated in FIGS. 9 and 10 is the cutout or notch L that straddles the web cut line 78. The full cutout L is preferably elliptical or circular as shown and one half of the cutout is formed on one side of the line 78 while the other half is formed on the opposite side. Thus, a single punching step forms a cutout or notch in two adjacent bags 10. This cutout or notch L serves the same purpose as the side notches 40, 42 illustrated in FIG. 5 and described above. In one particular preferred embodiment, the diameter of the full, circular cutout is 1.25 inch or 31.75 mm.

Turning now to the more detailed view of FIG. 10 which shows the web cut line 78 in the centre, a few additional dimensions are shown. In particular, the distance O between the adjacent ends of protective bands 22 of sections of the plastic web for two bags is indicated. In one preferred embodiment, this distance is 0.25 inch or 6.35 mm. One half of the distance o is the distance of the end of each protective band 22 from the cut line 78. Also indicated is the distance P which is less than the distance O. One half of the distance P is the distance from the end of each adhesive strip to the cut line 78. Also shown is the width of the seal area represented by the letter Q and the length of the seal area represented by the letter R, this seal area extending over end sections of adjacent adhesive strips 20. This seal area 80 is a wider area of the first wall 19 and the second wall 13 that is sealed together during the heat sealing step in the manufacture of the bag 10. As indicated, the adhesive material preferably extends into this area 80 so that there is a clear overlap between the wider sealed area and the ends of the adhesive strips 20. This helps to ensure a good seal in this region of the bag and helps to prevent a faulty bag seal due to lack of adhesive in the open end section of the bag at either end of the adhesive strip. Preferably the top edge of the area 80 is rounded as shown.

Figure 11:
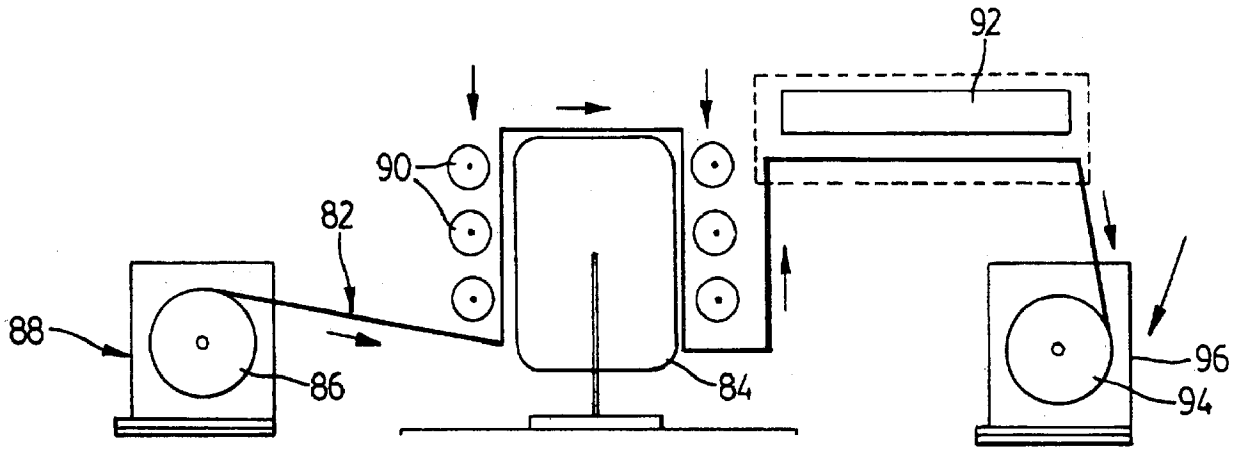
FIG. 11 is a schematic elevational view showing the production sequence for one method of making modified plastic sheeting suitable for manufacturing bags according to the invention, this view illustrating Flexographic printing on a stack printing press.

Turning to FIG. 11, this figure schematically illustrates one of three different methods that can be used to make modified plastic sheeting suitable for the manufacture of the above described sealable bags. This method includes delivering an extruded elongate strip 82 of suitable plastic sheeting to a printing press 84. The elongate strip can be provided in the form of a roll 86 which can be mounted on a standard unwind stand 88. It will be understood that the roll 86 of plastic sheeting can be extruded in a separate stand alone process for manufacturing plastic sheeting, a process well known in the plastic industry. The plastic film is Flexo printed/coated with one to six colors on the printing press 84 which can be a stack printing press having six printing stations 90, three on each side of the press. Using this Flexographic printing, it is possible to print up to three colors on two sides and the release coating can be placed on one side of the plastic web as well using the same printing press. The release coating can be applied by the printing press to form the protective band 22 described above using an aqueous coating of release material. It will be understood that the band 22 (which is initially an intermittent long band as described) extends parallel to and is located the preselected distance K from one longitudinal edge of the elongate strip 82. After the aqueous coating is applied, this coating is dried and cured using inline drying equipment 92. The equipment 92, of course, cures the ink or inks on the plastic sheeting as well. The resulting, modified plastic sheeting can then be wound into a finished roll 94 which can, for example, be 20 to 24 inches in diameter. The roll 94 is formed on a wind up stand 96 of standard construction.

A preferred form of drying equipment for this method is a heated forced air dryer, the use of which is well known in the printing industry. The finished rolls of plastic sheeting 94 can be used at a bag manufacturing facility which can be located remotely from the printing facility where the printing press 84 is located.

Figure 12:
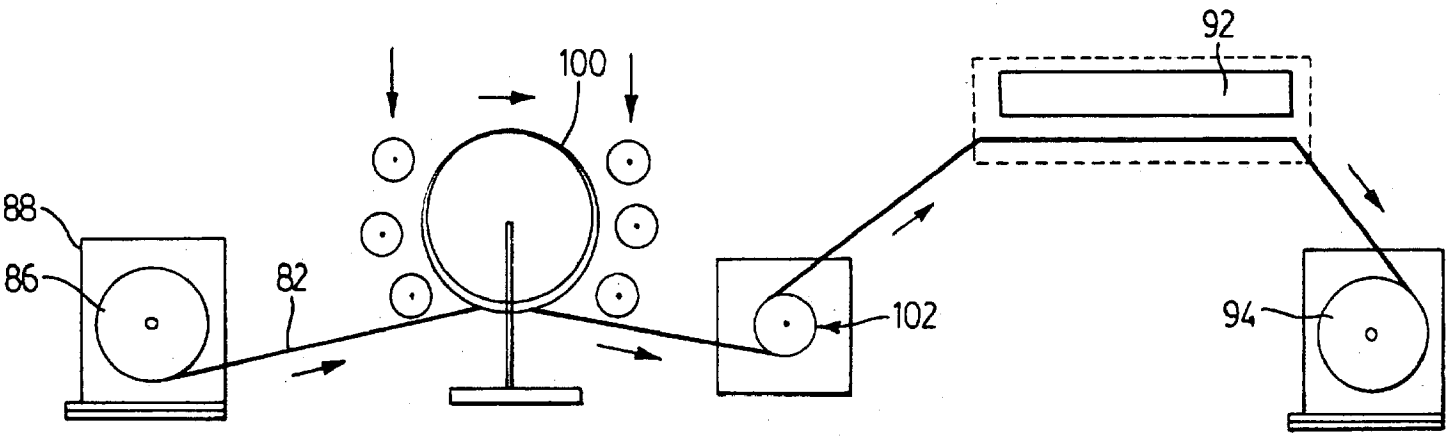
FIG. 12 is a schematic elevational view illustrating in an alternate method of making modified plastic sheeting suitable for manufacturing bags, this method also employing Flexographic printing together with a separate coating station applying a release coating to the plastic sheeting.

Another method for manufacturing modified plastic sheeting using Flexographic printing is illustrated in FIG. 12 and this method has several steps in common with the method of FIG. 11. Again, plain, unprinted and uncoated plastic film in the form of a roll 86 is placed on an unwind stand 88, this stand being located on the input side of a central impression Flexographic printing press 100. The plastic sheeting or film is Flexo printed/coated on the outside surface of the sheeting and up to six, eight and even 10 colors can be printed using this form of printing press. A high quality process image can be printed using this method. The interrupted band of a release coating is not applied by the printing press but by means of a single coating station 102. This single coating station places the long band (made up of a series of short bands) of the aqueous coating of release material on the back side of the plastic web. The coating station 102 can itself be of known construction and can, for example, be the Rotogravure or Flexographic type. The printed and coated web is then fed to the drying equipment 92 which is able to cure both the release coating and the inks forming the color images and/or text. The thus modified plastic sheeting is wound onto the finished roll 94 which can then be delivered to a bag forming machine in order to produce the above described bags or envelopes. A variation of this particular process for making the modified plastic sheeting is to use a number of inline Rotogravure printing stations, for example, six to ten stations, each with its own dryer unit. One of these stations can then be used to apply the release coating to the back side of the plastic web while the other printing stations are used for printing various colors on the plastic web to form images, text, etc.

Figure 13:
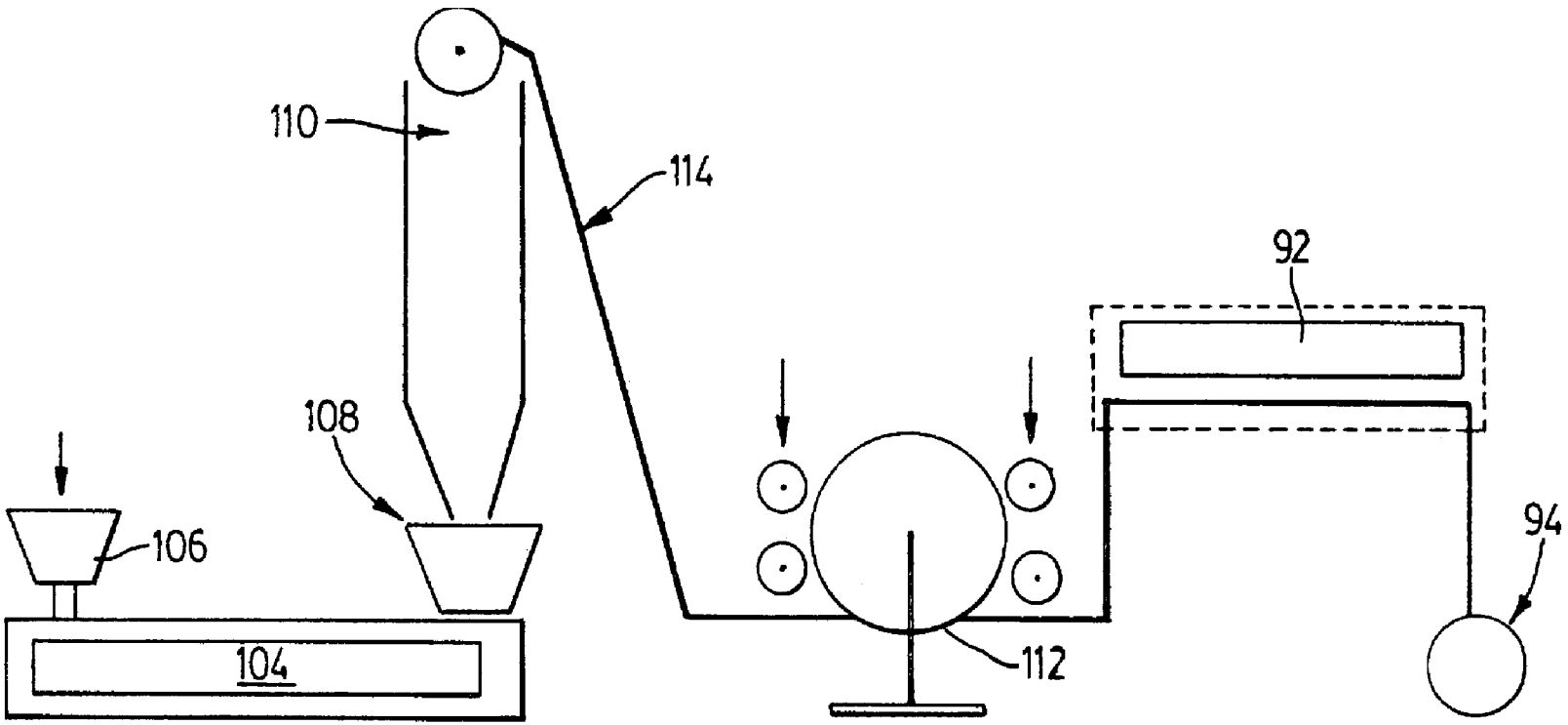
FIG. 13 is another schematic elevational view illustrating yet another method for manufacturing modified plastic sheeting suitable for the manufacture of the bags, this method employing a film extruder and a printing press.

FIG. 13 illustrates another method that can be used to produce the modified plastic sheeting used in the manufacture of the above described sealable bags. According to this method, the plastic sheeting is extruded in the same production line as the printing and application of the protective band 22. Shown in FIG. 13 is a film extruder 104. Plastic resin pellets are fed into a hopper 106 at the input end of the extruder. At the opposite end of the extruder is an extrusion die 108 and this extrusion machine is able to produce blown plastic film in tube form indicated at 110. Instead of forming the plastic film by this blown method, it is also possible to cast the film in a known manner. Using either method, the plastic film or sheeting travels from the extruder 104 to a printing press 112 without a break. Prior to entering the press, if the plastic sheeting is in tube form, it is converted to flat plastic sheeting indicated at 114. The plastic sheeting is Flexo coated and printed (with from one to six colors) on the printing press 112 which can be either a central impression or a stack printing press. One or both sides of the plastic film can be printed, depending on the type of press used. The printing press 112 has four to six print stations and one of these stations is used to apply the interrupted long band of aqueous coating of release material to the web. As in the two other processes, this aqueous coating is then cured by the drying equipment 92. At the same time, the inks of various colors are also cured. This printed and coated plastic sheeting is then wound into the finished roll 94 which can then be transported or otherwise delivered to a bag making machine.

With respect to the types of protective bands or release coatings that can be used, one type is an aqueous silicone coating that can be applied using a rubber plate or roller via the printing press. The silicone coating can be custom blended to control the bond strength with a given adhesive product to allow for individual and end use handling requirements. In addition to the use of a hot air oven as a dryer of this coating, it is also possible to use ultraviolet or high energy beam drying devices. Another possible material that can be used for the release material is a release varnish or lacquer and this material can be custom blended to form an aqueous coating that can be applied by a printing press using rubber or photopolymer printing plates. This type of release coating can be produced using various available polymer materials that are blended to create the desired release surface suitable for the adhesive to be used. This type of an aqueous coating can also be dried using either a hot air oven or the UV method (depending on the press that is used).

Figure 14:
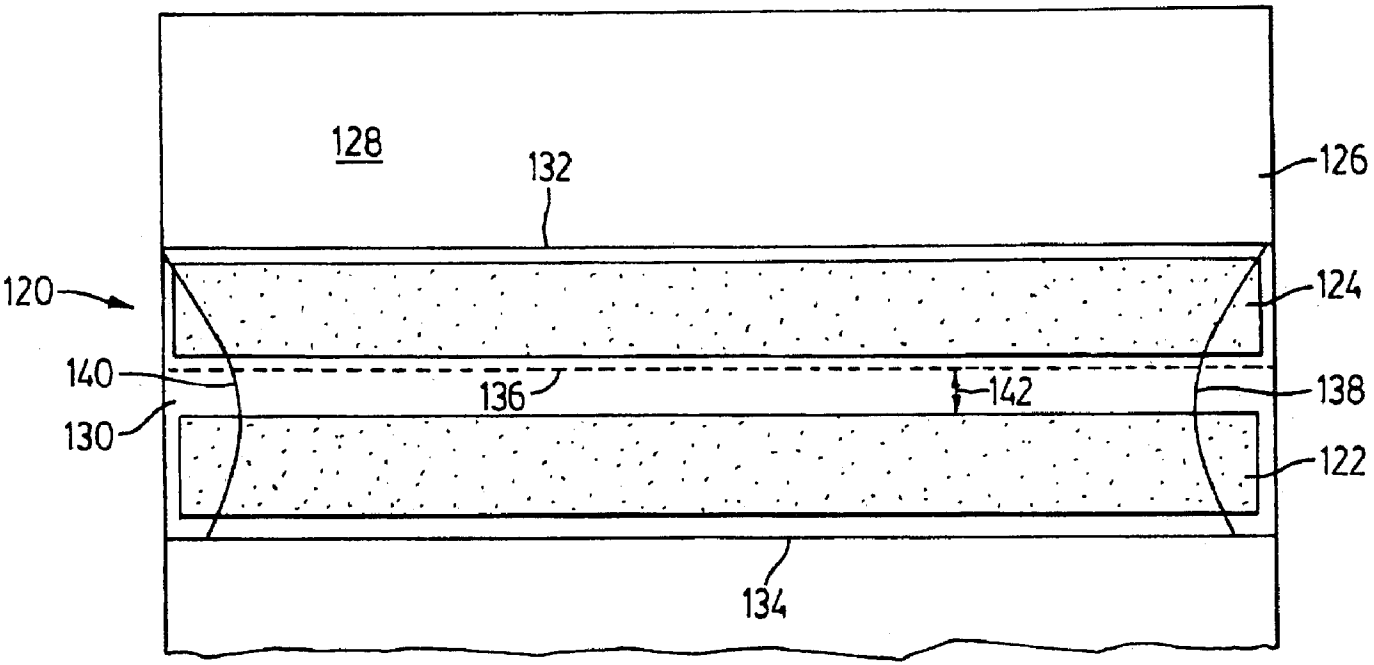
FIG. 14 is a front view of the upper portion of another embodiment of a sealable bag constructed according to the invention.

FIG. 14 illustrates another version of a sealable bag constructed in accordance with the invention without only the upper portion of the bag being shown for ease of illustration. This bag version indicated generally by reference 120 is similar in its construction to the bag 10 except for the differences described herein. The bag 120 is characterized by having two, separated adhesive bands indicated at 122 and 124. The adhesive band 122 can be a lower tack recloseable type adhesive while the second adhesive band 124 can be a so-called "tamper evident" high tack, hot melt adhesive. The flap portion indicated generally at 126 must in general be wider in the longitudinal direction in order to accommodate the two separate adhesive zones. The portion of the flap that extends beyond the bag opening, indicated by reference 128 in FIG. 14, can be 1.5 inches to 1.75 inches wide in the longitudinal direction. The relatively wide protective band 130 must be made wide enough to cover both adhesive zones. As illustrated, this protective band extends at least from the top fold line 132 to a bottom fold line 134. In preferred embodiments of the bags, this protective band 130 is slightly colored, for example with the color blue. This color helps to identify this region of the flap portion. It will also be noted that in this bag a line of perforations 136 is located in the mid zone between the two adhesive bands 122, 124 and this line is preferably formed in both walls of the bag and at the same height. Note also that cutouts 138, 140 are also formed on opposite side edges of the bag and these cutouts are similar to the cutouts L illustrated in FIG. 9.

The bag 120 can be used in a somewhat similar manner to the bag 10. As with the bag 10, the bag user first places the contents into the bag 120 through the open end formed at the top of the two walls. The flap portion 126 is then pulled upwardly (that is, away from the center of the bag), thereby exposing the two adhesive strips 122, 124. Pressure is then applied in order to close the bag in a sealing manner. For this purpose, at least the high tack adhesive strip 124 is used but it is also possible to use the adhesive strip 122. Once the bag and its contents reach the final user, an upper end portion of the bag can be removed, that is, the portion above the line of perforations 136. Because the line of perforations extends through both walls of the bag, the upper portion can be fully removed. The remaining main portion of the bag can now be opened and closed several times by using the low tack adhesive strip 122. Thus, this bag construction affords the user the option to remove the bag contents and reseal the bag several times. In order to assist in this reuse of the bag, an access lip 142 is preferably provided between the line of perforations 136 and the adhesive strip 122. It will be seen that this bag 120 represents a version of the invention that is capable of providing a tamper evident bag or envelope with the option of being able to reuse the bag or envelope one or more times.

Figure 15:
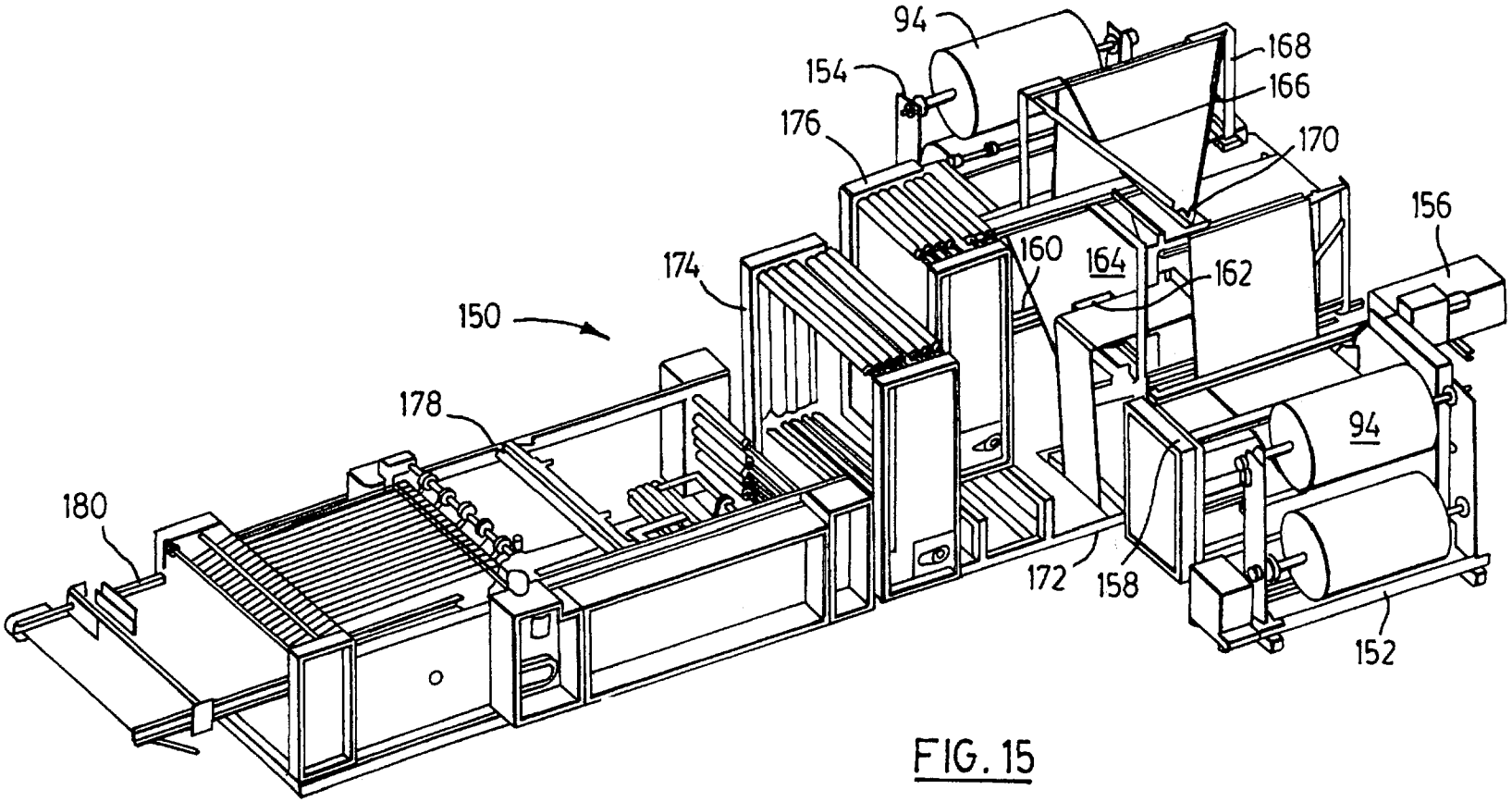
FIG. 15 is a schematic perspective view, taken from above, illustrating a bag forming machine that can be used to make the bags of the invention.

Illustrated in FIG. 15 is one form of bag making machine that can be used to produce the bag 10 or the bag 120 of the invention. This machine 150 includes dual unwind stands 152, 154 on opposite sides of the machine at one end. These stands, which can be of standard construction, are able to hold two modified plastic sheeting rolls 94 and they are constructed in a manner well known in the packaging industry. One of these rolls is for actual use in delivering a plastic web to the bag forming machine while the other roll is held as a spare so that it can be used as soon as the first roll is finished. Shown on the right side of FIG. 15 is a suitable hot melt adhesive tank and pump system 156 such as a system available from Nordson Canada. This system is able to hold a suitable adhesive for the adhesive strip 20 at a specific, required temperature and dispenses adhesive material to the application gun or guns. A continuous punch station is provided at 158. This station uses a suitable web punching machine to form the desired notches 40, 42 or L in the moving web of plastic material before the folding operation takes place. The punch can be a pneumatic ball type punch mounted on an adjustable frame that allows the position of the punch to be moved relative to the edge of the web. The punch is able to perform a continuous motion type of die cut and operates at high speed so that the moving material does not drag and deform the cut hole. The aforementioned optical eye mark on the moving web, together with a standard triggering device, determines when the punch activates to make the hole in the web.

A web folding device 160 creates the fold in the web that contains the release material and that is used to provide the flap portion of the bag. The adhesive strip is applied by an adhesive application gun at 162, the position of which can be adjusted by a gun armature. These adhesive guns are available from Nordson Canada. The gun dispenses a hot melt adhesive by a non-contact method onto the moving web and the adhesive can be pattern coated in the machine direction of the web. While the adhesive is being applied, the moving web is supported on sloping support panel at 164. Located above this panel is a center folder unit 166 which is supported on a vertically extending frame 168. This unit takes the flat web sheeting and can fold it into a U or J type configuration. The web flows in an uninterrupted continuous motion over the center folder which reconfigures the web into the final bag geometry with its first and second walls, as described above. Such center folder devices, with or without gusset folder tips, are standard equipment in the film and bag converting industry. Accordingly, a detailed description herein is deemed unnecessary. The J fold is used for bags that do require a wicket lip. If the gusset folder is provided with this center folder, it creates a deposition of film material at the bottom of the bag that allows the base to fan out when the user places contents into the bag enclosure. A "stand-up" type bag with the adhesive closure of the invention can be made using this equipment. The bottom gusset folder is located at 170.

It will be understood that the machine 150 is built on a base frame 172 that can be fixed to the floor. Downstream of the center folder are dual web accumulators 174 and 176 of known construction. These accumulators are used to store the folded web material under constant tension so that the machine is ready to feed this material to the actual bag-making portion of the machine which operates on an intermittent basis. In other words, the dual web accumulators permit the first portion of the machine including the folding devices and the punching and glue application systems to operate on a continuous basis while the portion of the machine 150 downstream of the accumulators can operate in the required intermittent fashion.

Located downstream of the accumulators is the bag production portion 178 of the machine. This machine is able to form any further desired holes, such as wicket holes, by means of punches, to form die cut handles, if desired, and to actually form the separate bags by a severing and sealing operation before these bags are transported to an index tablet 180. The bag production portion can use standard bag forming equipment known in the plastic bag industry. The bag production portion 178 can run as a single or double lane unit, the latter producing two streams of bags at the same time. The index table 180 is able to count out bags into groups in a known manner and place the stacked product into orderly rows ready for the packer to handle.

Figure 16:
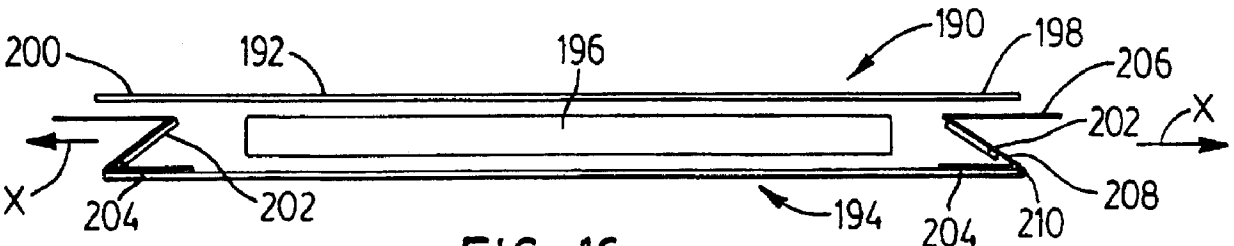
FIG. 16 is a cross-sectional view of yet another embodiment of a sealable bag constructed according to the invention.

FIG. 16 illustrates a further embodiment of a bag or enclosure that could be constructed in accordance with the invention. Except as indicated hereinafter, it will be understood that this bag 190 is constructed in a similar manner as the above described sealable bags. The back wall or second wall of this bag is indicated at 192 while the front wall or first wall is indicated at 194. The bag 190 as shown has an object 196 located therein and this object may be printed matter, for example. The bag 190 is shown extending horizontally with one end, which may be the top end 198 on the right and a second end, which can be the bottom end 200 on the left side of the drawing. It will be understood that although both ends 198 and 200 are shown with sealable closures constructed in accordance with the invention, the bag 190 can also be constructed with only one sealable closure at either of the ends 198, 200, if desired. A significant feature of this bag 190 is the location of the adhesive band 202 and the location of the protective band 204. In this bag 190, the adhesive band or strip 202 is located on the flap portion 206 and, in particular, is located on an inner section 208 of the flap portion. With this construction, the adhesive strip 202 will be exposed when the flap portion is pulled outwardly in the direction of the arrow X. Because of this arrangement, the user of the bag 190 can attach the bag or envelope to a surface with the front or first wall 194 facing forward. It will be understood that the flap portion can be folded along the fold line 210 in order to apply the adhesive strip to the outside surface of the back wall 192, thereby closing this end of the bag. The protective band is formed on an inner surface of the front wall 194 adjacent to the fold line 210. As in the previous embodiments, the bag making machine applies its side welds along the side edges of the bag 190 where the walls 192 and 194 meet.

The sheeting material used to form the bag 190 can also be printed with images and/or text prior to the formation of the bag itself by the same printing methods as described above. Alternatively, or in addition, printed material can be placed in the bag 190 and the printed matter on this material, ie. the object 196, can be made visible through the walls of the bag.

Whether the bag 190 is formed with a single sealable flap portion or two sealable flap portions (as shown) will depend on the needs of the end user. As in the previous embodiments, the adhesive contact area and the strength of the adhesive can be adjusted as required. It should be noted here that the adhesive band need not necessarily be a continuous band extending from one side of the bag opening to the opposite side. The term "adhesive band" or "adhesive band means" as used herein includes an intermittent adhesive band such as one made of short bands lined end-to-end and is also meant to include a band comprising a series of adhesive dots or adhesive areas aligned in a single row or even adjacent rows.

It will be appreciated that one of the advantages of the bag construction of FIG. 16 is that the adhesive strip 202 can not only be used to seal the end of the bag but it can also be used, if desired, to attach the bag to an adjacent support surface, for example, a wall or door, if desired. This may be particularly desirable if the bag with the enclosed object must be placed at a certain location in order to be visible or easily reached.

Sealable bags constructed in accordance with the invention have numerous possible applications, including possible use for packaging newspapers, magazines and advertising material. These bags can also be particularly advantageous for use with retail purchases that require a security closure for handling or transport within the retail store environment. Bags constructed in accordance with this invention can also be used as a general closure for plastic or paper packaging for use with food and non-food items where a rapid, secure closure is required without a heat seal. For example, in retail applications, these bags can be used to contain materials for the prevention of shoplifting, for maintaining product hygiene, and for providing consumer security of the packaged contents.

It will be apparent to those skilled in the packaging art that various modifications and changes can be made to the described bags and methods of the invention without departing from the spirit and scope of this invention. Accordingly, all such modifications and changes as fall within the scope of the appended claims are intended to be part of this invention.

I claim:

1. A bag comprising:

a first wall and a second wall, said walls being joined along their side edges and forming an open mouth portion proximate to top edges of said walls;

a flap portion, which is connected to said second wall, having opposite side edges and a free top edge, the latter being spaced above the top edge of said first wall, said flap portion thus having a projecting outer section extending above said open mouth portion and said flap portion and second wall together forming a transversely extending Z-fold, said flap portion also having an inner section connected along a first fold line of said Z-fold to said second wall and extending into the interior of said bag in an initial position thereof;

adhesive strip means for closing said open mouth extending in a transverse direction across one of an inner surface of said second wall and an inner surface of said inner section of the flap portion, said adhesive strip means being located proximate the top edge of said second wall;

protective band means for covering said adhesive strip means, said protective band means extending in a transverse direction across the other of said inner surface of said second wall and said inner surface of said inner section and contacting said adhesive strip means, wherein said projecting outer section can be pulled outwardly away from the interior of the bag to expose said adhesive strip means in order to close said open mouth portion during use of the bag.

2. A bag according to claim 1 wherein the length of said projecting outer section is at least one-half inch.

3. A bag according to claim 2 wherein said bag is made of plastic sheeting and has a closed bottom end and said protective band means comprises a coating of suitable release material applied to said plastic sheeting, said coating being applied to said inner section of said flap portion, and wherein said plastic sheeting has a uniform thickness of about 1 mil.

4. A bag according to claim 2 wherein said projecting outer section has a length of at least one and one-half inches and forms a wicket lip having two holes formed therein suitable for placement of said bag on wicket wires.

5. A bag according to claim 2 wherein said adhesive strip means comprises a continuous, high tack adhesive strip and one of said walls is provided with a line of perforations located proximate and below said adhesive strip, said line of perforations allowing said bag to be easily opened by tearing along said line.

6. A bag according to claim 2 wherein said bag is made of plastic film having a substantially uniform thickness of about 1 mil.

7. A bag according to claim 2 wherein said adhesive strip means comprises a first adhesive band made with a relatively low tack recloseable type adhesive and a second, parallel band of high tack, hot melt adhesive, said adhesive strips means extends across an inner surface of said second wall, and said protective band means is a release coating that covers and contacts both the first and second adhesive bands.

8. A bag according to claim 1 wherein said protective band means is a release coating having a width as measured in the longitudinal direction of said bag which exceeds the maximum width of said adhesive strip means measured in the same direction.

9. A bag according to claim 8 wherein said adhesive strip means is made with a pressure sensitive adhesive and has a total length measured in said transverse direction which is less than the width of said bag, said adhesive strip means having opposite outer ends each of which extends to a sealed side edge area of the bag where said first and second walls are sealingly connected to each other.

10. A bag according to claim 1 wherein said flap portion is formed with two side notches located on said opposite side edges thereof, said notches being proximate said first fold line of said Z-fold.

11. A bag according to claim 1 further including:

a second flap portion connected to said second wall at a bottom end of said bag and having opposite side edges and a free bottom edge, the latter being spaced below a bottom edge of said first wall, said second flap portion thus having a projecting outer section extending below a second open mouth portion of the bag proximate said bottom edge, said second flap portion and said second wall together forming a transversely extending second Z-fold, said second flap portion also having an inner section connected along a fold line of said second Z-fold to said second wall and extending into the interior of said bag in an initial position thereof;

second adhesive strip means for closing said second open mouth portion extending in a transverse direction across an inner surface of said inner section of said second flap portion; and second protective band means for covering said second adhesive strip means, said second protective band means extending in a transverse direction across said inner surface of said second wall and contacting said second adhesive strip means.

12. A bag comprising:

first and second bag walls joined along their side edges and forming an open mouth portion proximate to top edges of the walls, said walls having a width measured between said side edges;

a flap portion connected to the top edge of said second wall and having opposite side edges and a free top edge, said flap portion and said second wall together forming a transversely extending Z-fold having first and second fold lines, said first fold line located at the junction of said second wall and said flap portion, said flap portion including a transversely extending first section having opposite ends formed by said first and second fold lines and extending into the interior of said bag in an initial position thereof, said flap portion also including a transversely extending second section located between said second fold line and said top edge of the flap portion, at least a substantial portion of said first section having a reduced width which is less than said width of said walls;

adhesive strip means for closing said open mouth portion extending in a transverse direction across one of an inner surface of said second wall and an inner surface of said first section of the flap portion, said adhesive strip means being proximate the top edge of said second wall; and protective band means for covering said adhesive strip means, said protective band means extending in a transverse direction across the other of said inner surface of said second wall and said inner surface of the first section of the flap portion;

wherein said flap portion can be pulled outwardly away from the interior of said bag to expose said adhesive strip means in order to close said open mouth portion during use of the bag, said reduced width of said first section of said flap portion preventing this reduced width portion from being joined to said bag walls during the making of said bag.

13. A bag according to claim 12 wherein said bag has a closed bottom end, said adhesives strip means extends across said inner surface of said second wall and said protective band means extends across said inner surface of said first section of the flap portion.

14. A bag according to claim 13 wherein said adhesive strip means includes a first adhesive band made of a relatively low tack, pressure sensitive adhesive and a parallel second band of high tack adhesive, and wherein a line of perforations extends transversely across said first and second bag walls and is located between said first and second adhesive bands.

15. A bag according to claim 13 wherein said adhesive strip means is a continuous, high tack adhesive strip and at least one of said walls is provided with a line of perforations located proximate and below said adhesive strip, said line of perforations allowing said bag to be reopened by tearing along said line.

16. A bag according to claim 13 wherein said adhesive strip means has a total length measured in the transverse direction of said bag which is less than a corresponding dimension of said protective band means and less than the transverse width of said bag, and said adhesive strip means has opposite outer ends each of which extends to a sealed edge area of the bag where said first and second bag walls are sealingly connected.

17. A bag according to claim 13 wherein both said substantial portion of said first section of the flap portion and an adjacent portion of said second section of the flap portion have said reduced width so that these reduced width portions are not joined to the bag walls.

18. A bag according to claim 12 wherein said adhesive strip means extends across said inner surface of said first section of the flap portion and said protective band extends across said inner surface of said second wall.

19. A bag according to claim 12 wherein said bag walls are made of plastic film having a substantially uniform thickness which is less than 1.5 mil.

20. A sealable bag comprising:

first and second walls joined along their side edges and forming an open mouth portion proximate to top edges of said walls, a flap portion connected to said second wall and having opposite side edges and a free top edge, said flap portion and said second wall together forming a transversely extending Z-fold, said flap portion including an inner section connected along a first fold line of said Z-fold to said second wall and extending into the interior of said bag in an initial position thereof;

a continuous adhesive strip for closing said open mouth portion extending in a transverse direction across an inner surface of said second wall and located proximate the top edge of said second wall, said adhesive strip having a total length measured in the transverse direction of the bag which is less than the transverse width of the bag, opposite ends of said adhesive strip being located immediately next to or in sealed edge areas of the bag where said first and second walls are sealingly connected;

a protective band extending in a transverse direction across said inner section so as cover and contact said adhesive strip;

wherein, during use of said bag, said flap portion can be pulled away from the interior of the bag to expose said adhesive strip which can then be used to close said open mouth portion in a substantially watertight manner.

21. A sealable bag according to claim 20 wherein said protective band is a release coating having a width in the longitudinal direction of the bag which is greater than the width of said adhesive strip.

22. A sealable bag according to claim 21 wherein said flap portion is formed with two side notches located on said opposite side edges and proximate said first fold line of said Z-fold.

23. A sealable bag according to claim 20 wherein said first and second walls are made of plastic film having a substantially uniform thickness of about 1.0 mil.

* * * * *